US012370592B1

(12) United States Patent
Cao et al.

(10) Patent No.: US 12,370,592 B1
(45) Date of Patent: Jul. 29, 2025

(54) CONVEXITY ADJUSTING MECHANISM FOR WORKING ROLL OF STRAIGHTENING MACHINE

(71) Applicant: TAIYUAN UNIVERSITY OF TECHNOLOGY, Taiyuan (CN)

(72) Inventors: Yizhong Cao, Taiyuan (CN); Hao Yuan, Taiyuan (CN); Da Ha, Taiyuan (CN); Weirong Zhang, Taiyuan (CN); Nan Yang, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 19/190,726

(22) Filed: Apr. 27, 2025

(30) Foreign Application Priority Data

Sep. 4, 2024 (CN) ..... 202411236590.8

(51) Int. Cl.
*B21D 1/02* (2006.01)

(52) U.S. Cl.
CPC ..... *B21D 1/02* (2013.01)

(58) Field of Classification Search
CPC . B21D 1/02; B21D 1/06; B21D 37/38; B21D 37/40; B21D 37/42; B21B 29/00; B21B 2015/0071
USPC ..... 72/160, 163–165, 452.4, 241.2, 241.4, 72/249; 74/10.27–10.37, 337.5, 567
See application file for complete search history.

(56) References Cited

U.S. PATENT DOCUMENTS

| | | | | | |
|---|---|---|---|---|---|
| 2,049,142 | A * | 7/1936 | Ungerer | ..... | B21D 1/02 72/163 |
| 2,091,789 | A * | 8/1937 | Maussnest | ..... | B21D 1/02 72/183 |
| 3,420,082 | A * | 1/1969 | Bearer | ..... | B21D 1/02 72/163 |

FOREIGN PATENT DOCUMENTS

| | | | | | |
|---|---|---|---|---|---|
| CN | 106001178 | A | * 10/2016 | ..... | B21D 1/02 |
| CN | 118287536 | A | 7/2024 | | |
| CN | 221388136 | U | 7/2024 | | |
| GB | 489533 | A | * 7/1938 | ..... | B21D 1/02 |
| JP | 05261438 | A | * 10/1993 | | |
| JP | 2005052860 | A | 3/2005 | | |
| WO | 2022037486 | A1 | 2/2022 | | |

* cited by examiner

*Primary Examiner* — Christopher L Templeton
*Assistant Examiner* — P Derek Pressley

(57) ABSTRACT

The disclosure discloses a convexity adjusting mechanism for a working roll of a straightening machine and relates to the field of plate straightening devices. The convexity adjusting mechanism for the working roll of the straightening machine comprises a transmission shaft, a plurality of convexity adjusters, working rolls and supporting rolls corresponding to each convexity adjuster. The transmission shaft, the supporting rolls and the working rolls are axially parallel; the convexity adjust comprises a sleeve, a cam and a controller; the cam is provided with a through hole, the sleeve is mounted in the through hole, and the cam is sleeved on the transmission shaft through the sleeve; the sleeve is connected with the controller, and one end of the sleeve is provided with a gripping clawt.

10 Claims, 4 Drawing Sheets

CONVEXITY ADJUSTING MECHANISM FOR WORKING ROLL OF STRAIGHTENING MACHINE

CROSS REFERENCE TO RELATED APPLICATIONS

This application claims foreign priority of Chinese Patent Application No. 202411236590.8, filed on Sep. 4, 2024 in the China National Intellectual Property Administration, the disclosures of all of which are hereby incorporated by reference.

TECHNICAL FIELD

The present disclosure relates to the field of plate straightening device, in particular to a convexity adjusting mechanism for a working roll of a straightening machine.

BACKGROUND OF THE PRESENT INVENTION

Wide and thick plates are widely used in national key projects, national defense construction and various infrastructure fields, involving ships, bridges, electric power, automobiles, chemicals, machinery, construction and oil pipelines and other industries. In order to ensure flatness accuracy of the plates and eliminate stress, a straightening machine has become a key finishing device, the performances of which are directly related to a quality of a material surface and the flatness of the whole plate.

At present, in practical production and disclosure, convexity adjustment of the straightening machine mainly depends on a hydraulic cylinder to push a wedge block, so as to adjust a convexity of the supporting roll, and then adjust a convexity of a working roll online. However, in this adjustment method, a plurality of supporting rolls share one set of adjusting mechanisms usually, and it is impossible to independently adjust the convexity of each supporting roll online.

Therefore, how to realize flexible and dynamic adjustment of the convexity of each supporting roll on the straightening machine, so as to improve straightening accuracy and surface quality of the plate and reduce residual stress after straightening has become an urgent technical problem for the technicians of the present disclosure.

SUMMARY OF THE PRESENT INVENTION

The present disclosure aims at providing a convexity adjusting mechanism for a working roll of a straightening machine to realize flexible and dynamic adjustment of the convexity of each supporting roll on the straightening machine, thereby improving a straightening accuracy and a surface quality of a plate and reducing residual stress of the plate after straightening.

In order to achieve the above objects, the present disclosure provides the following technical solutions.

A convexity adjusting mechanism for a working roll of a straightening machine comprises:

a transmission shaft, a plurality of convexity adjusters, working rolls and supporting rolls corresponding to each convexity adjuster, wherein the transmission shaft, the supporting rolls and the working rolls are axially parallel;

the convexity adjust comprises a sleeve, a cam and a controller; the cam is provided with a through hole, the sleeve is mounted in the through hole, and the cam is sleeved on the transmission shaft through the sleeve; and the sleeve is connected with the controller, and one end of the sleeve is provided with a gripping claw;

after the controller is powered on, the sleeve is driven to move along an axial direction of the transmission shaft until the gripping claw cooperates with the through hole to grip the transmission shaft, so that the transmission shaft drives the cam to rotate to adjust a convexity of the supporting roll; and the working roll is contacted with the supporting roll, and the working roll is used for adjusting a shape defect of a processed material based on the convexity of the supporting roll.

In an optional embodiment of the present disclosure, a detector is further comprised;

the detector being used for measuring a plate shape of the processed material, determining a defect position of the processed material with a plate shape defect, and sending a power-on signal to the controller of the convexity adjuster corresponding to the defect position to power on the controller.

In an optional embodiment of the present disclosure, the detector comprises: a laser rangefinder or a plate shape measuring instrument.

In an optional embodiment of the present disclosure, the controller comprises: a clamping groove, a transposition fork, an armature iron and an electromagnet; and the armature iron is mounted on the transposition fork;

the clamping groove is sleeved on the other end of the sleeve, and the transposition fork is clamped in the clamping groove; and after the controller is powered on, the electromagnet attracts the armature iron, so that the armature iron drives the transposition fork to move, and then drives the sleeve to move until the gripping claw arranged at one end of the sleeve grips the transmission shaft tightly.

In an optional embodiment of the present disclosure, the clamping groove is a clamping groove nut; the clamping groove nut is sleeved on the other end of the sleeve through the thread.

In an optional embodiment of the present disclosure, the controller further comprises: a transposition base, a reset spring and a guide bar;

the reset spring and the transposition fork are sleeved on the guide bar, and the guide bar and the electromagnet are fixed on the transposition base;

after the controller is powered on, the electromagnet attracts the armature iron, so that the armature iron drives the transposition fork to move, and then drives the sleeve to move to contract the reset spring; and after the controller is powered off, the reset spring in the contracted state exerts a thrust on the transposition fork to reset the transposition fork and further drive the sleeve to reset.

In an optional embodiment of the present disclosure, the transposition base is a U-shaped base; and the electromagnet is fixed on one end of the U-shaped base, and the transposition fork is sleeved on the other end of the U-shaped base.

In an optional embodiment of the present disclosure, the through hole of the cam is provided with a spline groove; and a middle portion of the sleeve is provided with a spline; and the cam is sleeved on the sleeve through cooperation of the spline and the spline groove.

In an optional embodiment of the present disclosure, the convexity adjusting mechanism for the working roll of the straightening machine further comprises a motor; and the motor is used for driving the transmission shaft to rotate.

In an optional embodiment of the present disclosure, a coupling is mounted at one end of the transmission shaft, and the coupling is meshed with an output shaft of the motor through a bevel gear pair.

Compared with the prior art, according to the convexity adjusting mechanism for the working roll of the straightening machine provided by the present disclosure, the plurality of convexity adjusters and the supporting rolls corresponding to the convexity adjusters are arranged on the transmission shaft, and the relative positions of the cams and the sleeves in the convexity adjusters are controlled by the controllers, so that the gripping claws in the sleeves are matched with the through holes in the sleeves to hold the transmission shaft when necessary, and the cams in the convexity adjusters are driven to rotate through the transmission shaft to adjust the convexity of the supporting roll corresponding to the convexity adjuster, so that the working rolls can adjust the shape defect of the processed material based on the convexity of the supporting roll. The present disclosure realizes flexible and dynamic adjustment of the convexity of each supporting roll on the straightening machine, thereby improving the straightening accuracy and the surface quality of the plate and reducing the residual stress of the plate after straightening.

DESCRIPTION OF THE DRAWINGS

The accompanying drawings illustrated here serve to provide a further understanding of the present disclosure and constitute a part of the present disclosure, and the illustrative embodiments of the present disclosure and together with the description thereof serve to explain the present disclosure, and do not constitute inappropriate definition to the present disclosure. In the drawings.

REFERENCE NUMERALS

Figure 1:
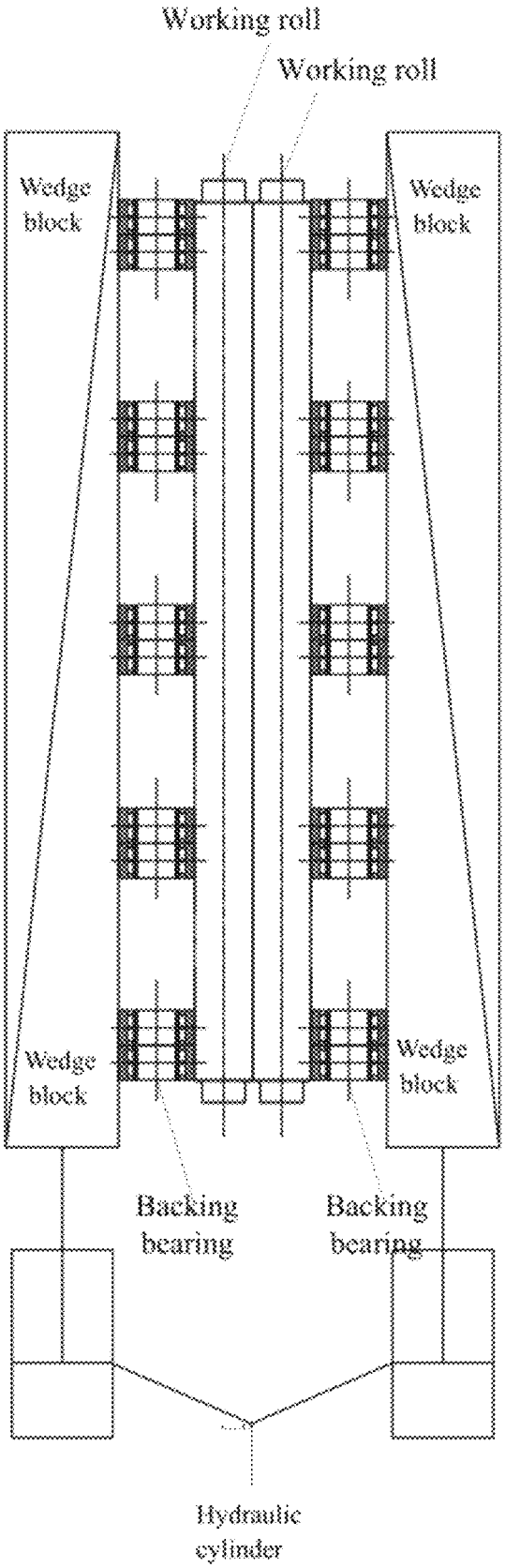
FIG. 1 is a schematic structural diagram of a straightening machine provided by the prior art of the present disclosure.

1—working roll; 2—supporting roll; 3—bevel gear pair; 4—motor, 5—coupling; 6—transmission shaft; 7—cam; 8—sleeve; 9—clamping groove; 10—transposition fork; 11—reset spring; 12—electromagnet; 13—transposition base; 14—gripping claw; 15—armature iron; 16—guide bar; 17—spline groove; 18—spline; 19—thread; a—crown adjuster; b—controller; c—through hole; 20—entry section; and 21—contraction section.

DETAILED DESCRIPTION OF PREFERRED EMBODIMENTS

To make the technical problems to be solved, technical solutions, and beneficial effects of the present disclosure clearer, the present disclosure will be further described in details hereinafter with reference to the accompanying drawings and embodiments. It should be understood that the specific embodiments described herein are only used to explain the present disclosure, but are not intended to limit the present disclosure.

It should be noted that when an element is called to be "fixed" to or "arranged on" another element, it may be directly fixed to or arranged on another element or indirectly fixed to or arranged on another element. When an element is considered to be "connected" to another element, it may be directly connected to another element or indirectly connected to another element.

Moreover, the terms "first" and "second" are only used for descriptive purposes, but cannot be understood as indicating or implying relative importance, or implicitly indicating the number of indicated technical features. Therefore, the features defined with "first", "second" and "third" can explicitly or implicitly include one or more of the features. In the description of the present disclosure, the meaning of "a plurality of" is two or more than two unless otherwise specifically defined. The meaning of "several" is one or more than one unless otherwise specifically defined.

In the description of the present disclosure, it should be understood that, the orientation or position relationship related to the orientation description, such as the orientation or position relationship indicated by the terms "up", "down", "front", "back", "left", "right" and the like is based on the orientation or position relationship shown in the drawings, which is only used for convenience of the description of the present disclosure and simplification of the description instead of indicating or implying that the indicated device or element must have a specific orientation, and be constructed and operated in a specific orientation, and thus should not be understood as a limitation to the present disclosure.

In the description of the present disclosure, it should be noted that terms such as "installation", "connected" and "connection", etc., should be understood broadly, for example, the connection may be fixed connection, or detachable connection or integral connection; may also be mechanical connection or electrical connection; and may be direct connection, may also be indirect connection through an intermediate medium, and may also be internal communication of two elements or interaction relationship of two elements. The specific meaning of the above terms in the present disclosure can be understood in a specific case by those of ordinary skills in the art.

Wide and thick plates are widely used in national key projects, national defense construction and various infrastructure fields, involving ships, bridges, electric power, automobiles, chemicals, machinery, construction and oil pipelines and other industries. In order to ensure flatness accuracy of the plates and eliminate stress, a straightening machine has become a key finishing device, the performances of which are directly related to a quality of a material surface and the flatness of the whole plate.

At present, in practical production and disclosure, convexity adjustment of the straightening machine mainly depends on a hydraulic cylinder to push a wedge block, so as to adjust a convexity of the supporting roll, and then adjust a convexity of a working roll online. Please refer to FIG. 1, which is a schematic structural diagram of a convexity adjusting mechanism for a working roll of a straightening machine provided by the prior art of the present disclosure.

As shown in FIG. 1, the convexity adjusting mechanism for the working roll of the straightening machine in the prior art comprises: stacked wedge blocks, backing bearings, working rolls and hydraulic cylinders, wherein the backing bearings are used as supporting rolls of the convexity adjusting mechanism for the working roll of the straightening machine. One of the stacked wedge blocks is connected with the hydraulic cylinder, and the other is fixed.

In the process of practical disclosure, a plate is sandwiched between a roll gap of the two working rolls shown in FIG. 1, and a thickness of the plate is adjusted by the rotary motion of the working rolls. Under the condition of uneven thickness of the plate, a motor pushes the wedge block connected therewith to drive the backing bearing to move towards the working roll, so as to adjust the convexity of the working roll and make the thickness of the plate uniform.

However, the backing bearings in this adjusting mechanism share one set of wedge blocks, and all the backing bearings connected with the wedge blocks will move together during the movement of the wedge blocks by the hydraulic cylinders, so as to adjust the convexity of the working roll. It can be seen that in the convexity adjusting mechanism for the working roll of the straightening machine in the prior art, it is not flexible to use the backing bearing as the supporting roll and cooperate with the wedge block to adjust the convexity of the working roll.

Therefore, how to realize flexible and dynamic adjustment of the convexity of each supporting roll on the straightening machine, thereby improving a straightening accuracy and a surface quality of a plate and reducing residual stress of the plate after straightening, has become an urgent technical problem for the technicians of the present disclosure.

In order to solve the above technical problems, the present disclosure provides a convexity adjusting mechanism for a working roll of a straightening machine.

Figure 2:
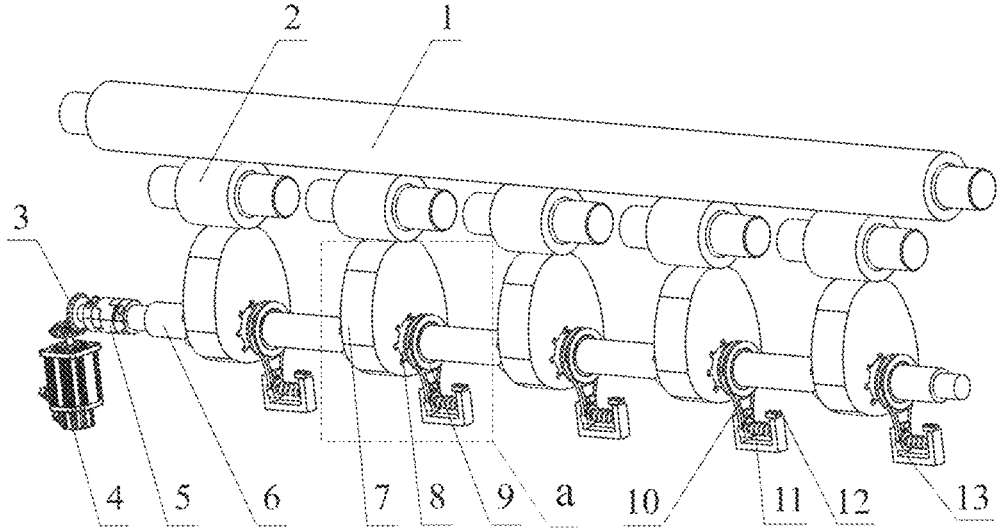
FIG. 2 is a schematic structural diagram of a straightening machine provided by the embodiments of the present disclosure.

Please refer to FIG. 2, which is a schematic structural diagram of the convexity adjusting mechanism for the working roll of the straightening machine provided by the embodiments of the present disclosure.

As shown in FIG. 2, the convexity adjusting mechanism for the working roll of the straightening machine comprises:

a transmission shaft 6, a plurality of convexity adjusters a, working rolls 1, and supporting rolls 2 corresponding to each convexity adjuster a, wherein the transmission shaft 6, the supporting rolls 2 and the working rolls 1 are axially parallel.

In the practical disclosure process, if the convexity of a certain position of a plate located in a roll gap of the working rolls 1 is abnormal, the convexity adjuster a corresponding to the position will rotate with the transmission shaft 6, and then the convexity of the supporting roll 2 corresponding to the convexity adjuster a will be changed, so that after the working roll 1 is contacted with the supporting roll 2, a shape defect of a processed material in the roll gap of the working rolls 1 will be adjusted based on the convexity of the supporting roll 2.

The abnormal convexity of the plate in the roll gap of the working rolls 1 can be obtained by monitoring the shape of the plate and the convexity of the roll by using a laser rangefinder or a plate shape measuring instrument.

Figure 3:
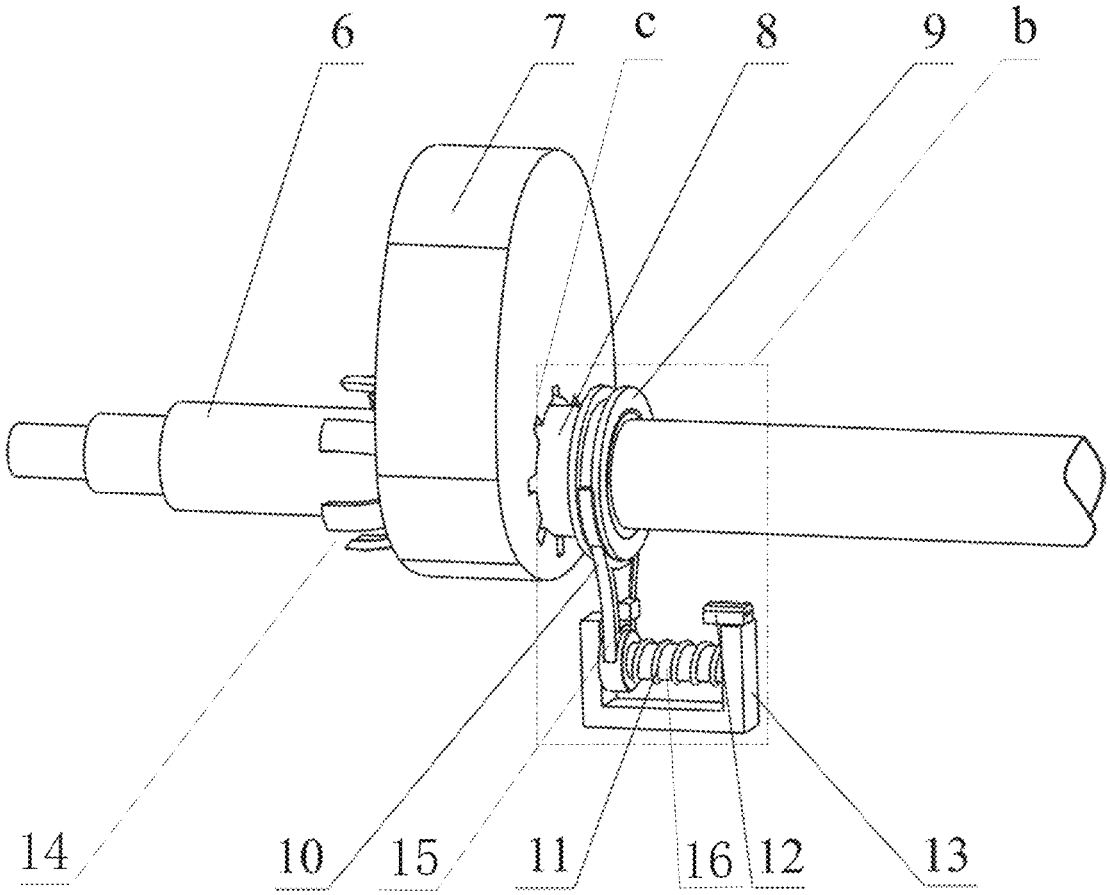
FIG. 3 is a schematic structural diagram of a convexity adjuster provided by the embodiments of the present disclosure.

Further, please refer to FIG. 3, which is a schematic structural diagram of a convexity adjuster provided by the embodiments of the present disclosure.

As shown in FIG. 3, the convexity adjuster comprises a sleeve 8, a cam 7 and a controller b. The cam 7 is provided with a through hole c, the sleeve 8 is mounted in the through hole c, and the cam 7 is sleeved on the transmission shaft 6 through the sleeve.

The sleeve 8 is connected with the controller b, and one end of the sleeve 8 is provided with a gripping claw 14. After the controller b is powered on, the sleeve 8 is driven to move along an axial direction of the transmission shaft 6 until the gripping claw 14 cooperates with the through hole c to grip the transmission shaft 6, so that the transmission shaft 6 drives the cam 7 to rotate to adjust a convexity of the supporting roll 2.

As mentioned above, the controller b is used for driving the sleeve 8 to move along the axial direction of the transmission shaft 6 until the gripping claw 14 cooperates with the through hole c to grip the transmission shaft 6 tightly.

Specifically, in order to enable the gripping claw 14 to cooperate with the through hole c to grip the transmission shaft, the through hole c comprises: an entry section and a contraction section of the gripping claw 14.

Figure 4:
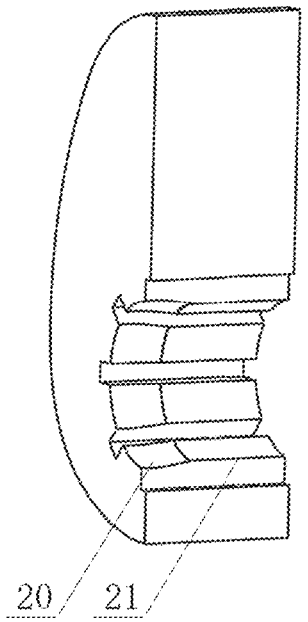
FIG. 4 is a sectional view of a cam provided by the embodiments of the present disclosure.

Please refer to FIG. 4, which is a sectional view of the cam provided by the embodiments of the present disclosure.

As shown in FIG. 4, the through hole c of the cam comprises: an entry section 20 and a contraction section 21.

A radius of a through hole of the entry section 20 is larger than a radius of a through hole of the contraction section 21, and an inclined plane is arranged between the entry section 20 and the contraction section 21 for the gripping claw 14 to smoothly transition from the entry section 20 to the contraction section 21 during the movement.

Further, the controller b comprises: a clamping groove 9, a transposition fork 10, an armature iron 15 and an electromagnet, wherein the armature iron is mounted on the transposition fork 10.

Specifically, the clamping groove 9 is sleeved on the other end of the sleeve 8, and the transposition fork 10 is clamped in the clamping groove 9.

After the controller b is powered on, the electromagnet 12 attracts the armature iron 15, so that the armature iron 15 drives the transposition fork 10 to move towards the electromagnet 12, and then drives the sleeve 8 to move towards the electromagnet 12 until the gripping claw 14 arranged at one end of the sleeve 8 grips the transmission shaft 6 tightly.

Further, the controller b further comprises: a transposition base 13, a reset spring 11 and a guide bar 16.

The reset spring 11 and the transposition fork 10 are sleeved on the guide bar 16, and the guide bar 16 and the electromagnet 12 are fixed on the transposition base 13.

Specifically, the transposition base 13 is a U-shaped base, the electromagnet 12 is fixed on one end of the U-shaped base, and the transposition fork 10 is sleeved on the other end of the U-shaped base.

After the controller is powered on, the electromagnet 12 attracts the armature iron 15, so that the armature iron 15 drives the transposition fork 10 to move, and then drives the sleeve 8 to move to contract the reset spring 11.

After the controller is powered off, the reset spring 11 in the contracted state exerts a thrust on the transposition fork 10 to drive the sleeve 8 to reset.

In an optional embodiment of the present disclosure, the clamping groove 9 is specifically a clamping groove nut, the other end of the sleeve 8 is provided with a thread, and the clamping groove nut is sleeved on the other end of the sleeve 8 through the thread.

In the embodiments of the present disclosure, in order to make the sleeve 8 move along the axial direction of the transmission shaft 6, and the transmission shaft 6 can drive the cam 7 to rotate together after the gripping claw 14 grips the transmission shaft 6, the through hole c in the cam 7 is provided with a spline groove; and a middle portion of the sleeve 8 is provided with a spline.

Figure 5:
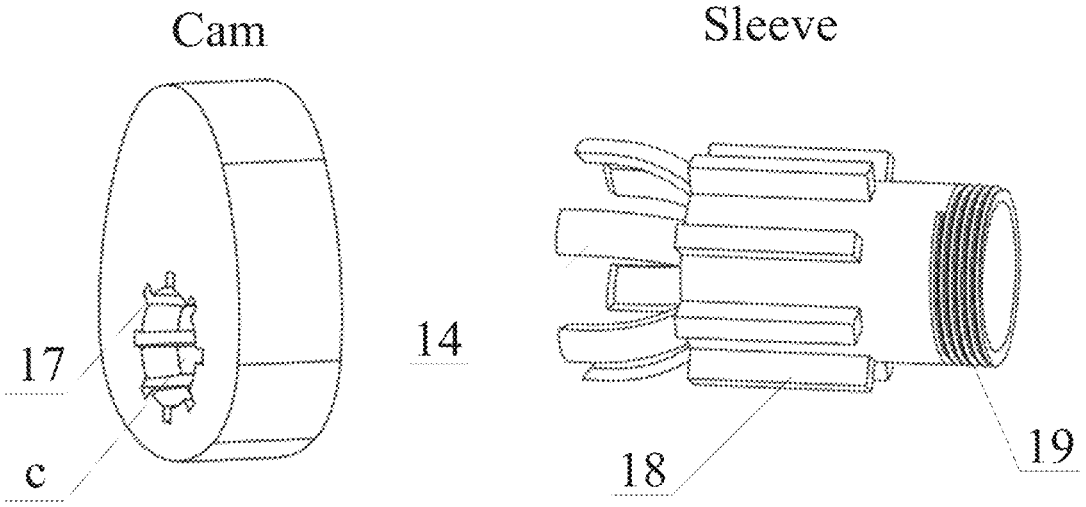
FIG. 5 is a schematic structural diagram of a cam and a sleeve provided by the embodiments of the present disclosure.

Further, please refer to FIG. 5, which is a schematic structural diagram of the cam and the sleeve provided by the embodiments of the present disclosure.

As shown in FIG. 5, the cam comprises the through hole c, and the spline groove 17 is arranged in the through hole c.

The sleeve comprises: the gripping claw 14, the spline 18 and the thread 19.

In the process of practical disclosure, the clamping groove nut of the controller b cooperates with the thread 19 to connect the transposition fork 10 of the controller b with the sleeve 8. During the axial movement of the sleeve 8 along the transmission shaft 6, the spline 18 on the sleeve 8 will enter the spline groove 17 in the through hole c until the gripping claw 14 enters the through hole c and the gripping claw 14 grips the transmission shaft 6 tightly. The transmission shaft 6 drives the sleeve 8 to rotate together, and meanwhile, the spline on the sleeve 8 cooperates with the spline groove on the cam 7, providing a rotating force for the cam 7 so as to drive the cam 7 to rotate together through the sleeve 8.

Please further refer to FIG. 2, wherein the straightening machine further comprises: a motor 4, wherein the motor 4 is used for driving the transmission shaft 6 to rotate; and a coupling 5 is mounted at one end of the transmission shaft 6.

The coupling 5 is meshed with an output shaft of the motor through a bevel gear pair 3. During the rotation of the output shaft of the motor 4, the bevel gear pair simultaneously drives the transmission shaft 6 to rotate.

In conclusion, according to the convexity adjusting mechanism for the working roll of the straightening machine provided by the present disclosure, the plurality of convexity adjusters and the supporting rolls corresponding to the convexity adjusters are arranged on the transmission shaft, and the relative positions of the cams and the sleeves in the convexity adjusters are controlled by the controllers, so that the gripping claws in the sleeves are matched with the through holes in the sleeves to hold the transmission shaft when necessary, and the cams in the convexity adjusters are driven to rotate through the transmission shaft to adjust the convexity of the supporting roll corresponding to the convexity adjuster, so that the working rolls can adjust the shape defect of the processed material based on the convexity of the supporting roll. The present disclosure realizes flexible and dynamic adjustment of the convexity of each supporting roll on the straightening machine, thereby improving the straightening accuracy and the surface quality of the plate and reducing the residual stress of the plate after straightening.

In the description of the above embodiments, the specific features, structures, materials, or characteristics may be combined in a suitable manner in any one or more embodiments or examples.

The foregoing descriptions are merely detailed embodiments of the present disclosure, but the protection scope of the present disclosure is not limited thereto. Any person skilled in the art can easily think of changes or substitutions within the technical scope of the disclosure, and all the changes or substitutions should be covered by the protection scope of the present disclosure. Therefore, the protection scope of the present disclosure should be subjected to the protection scope of the claims.

We claim:

1. A convexity adjusting mechanism for a working roll of a straightening machine, comprising: a transmission shaft, a plurality of convexity adjusters, working rolls and supporting rolls corresponding to each convexity adjuster, wherein the transmission shaft, the supporting rolls and the working rolls are axially parallel;

the convexity adjust comprises a sleeve, a cam and a controller; the cam is provided with a through hole, the sleeve is mounted in the through hole, and the cam is sleeved on the transmission shaft through the sleeve; and the sleeve is connected with the controller, and one end of the sleeve is provided with a gripping claw;

after the controller is powered on, the sleeve is driven to move along an axial direction of the transmission shaft until the gripping claw cooperates with the through hole to grip the transmission shaft, so that the transmission shaft drives the cam to rotate to adjust a convexity of the supporting roll; and the working roll is contacted with the supporting roll, and the working roll is used for adjusting a shape defect of a processed material based on the convexity of the supporting roll.

2. The convexity adjusting mechanism for the working roll of the straightening machine according to claim 1, further comprising a detector;

the detector being used for measuring a plate shape of the processed material, determining a defect position of the processed material with a plate shape defect, and sending an power-on signal to the controller of the convexity adjuster corresponding to the defect position to power on the controller.

3. The convexity adjusting mechanism for the working roll of the straightening machine according to claim 2, wherein the detector comprises: a laser rangefinder or a plate shape measuring instrument.

4. The convexity adjusting mechanism for the working roll of the straightening machine according to claim 1, wherein the controller comprises: a clamping groove, a transposition fork, an armature iron and an electromagnet; and the armature iron is mounted on the transposition fork;

the clamping groove is sleeved on the other end of the sleeve, and the transposition fork is clamped in the clamping groove; and after the controller is powered on, the electromagnet attracts the armature iron, so that the armature iron drives the transposition fork to move, and then drives the sleeve to move until the gripping claw arranged at one end of the sleeve grips the transmission shaft tightly.

5. The convexity adjusting mechanism for the working roll of the straightening machine according to claim 4, wherein the clamping groove is a clamping groove nut; the other end of the sleeve is provided with a thread; and the clamping groove nut is sleeved on the other end of the sleeve through the thread.

6. The convexity adjusting mechanism for the working roll of the straightening machine according to claim 4, wherein the controller further comprises: a transposition base, a reset spring and a guide bar;

the reset spring and the transposition fork are sleeved on the guide bar, and the guide bar and the electromagnet are fixed on the transposition base;

after the controller is powered on, the electromagnet attracts the armature iron, so that the armature iron drives the transposition fork to move, and then drives the sleeve to move to contract the reset spring; and after the controller is powered off, the reset spring in the contracted state exerts a thrust on the transposition fork to reset the transposition fork and further drive the sleeve to reset.

7. The convexity adjusting mechanism for the working roll of the straightening machine according to claim 6, wherein the transposition base is a U-shaped base; and the electromagnet is fixed on one end of the U-shaped base, and the transposition fork is sleeved on the other end of the U-shaped base.

8. The convexity adjusting mechanism for the working roll of the straightening machine according to claim 1, wherein the through hole of the cam is provided with a spline groove; and a middle portion of the sleeve is provided with a spline; and the cam is sleeved on the sleeve through cooperation of the spline and the spline groove.

9. The convexity adjusting mechanism for the working roll of the straightening machine according to claim 1, further comprising: a motor, wherein the motor is used for driving the transmission shaft to rotate.

10. The convexity adjusting mechanism for the working roll of the straightening machine according to claim 9, wherein a coupling is mounted at one end of the transmission shaft, and the coupling is meshed with an output shaft of the motor through a bevel gear pair.

* * * * *